US006692590B2

(12) United States Patent
Xing et al.

(10) Patent No.: US 6,692,590 B2
(45) Date of Patent: Feb. 17, 2004

(54) ALLOY WITH METALLIC GLASS AND QUASI-CRYSTALLINE PROPERTIES

(75) Inventors: Li-Qian Xing, St. Louis, MO (US); Todd C. Hufnagel, Baltimore, MD (US); Kaliat T. Ramesh, Baltimore, MD (US)

(73) Assignee: Johns Hopkins University, Baltimore, MD (US)

( * ) Notice: Subject to any disclaimer, the term of this patent is extended or adjusted under 35 U.S.C. 154(b) by 0 days.

(21) Appl. No.: 09/960,946

(22) Filed: Sep. 25, 2001

(65) Prior Publication Data

US 2002/0036034 A1 Mar. 28, 2002

Related U.S. Application Data

(60) Provisional application No. 60/234,976, filed on Sep. 25, 2000.

(51) Int. Cl.[7] ..... C22C 16/00

(52) U.S. Cl. ..... 148/561; 148/421; 148/403; 148/672; 420/423

(58) Field of Search ..... 148/561, 672, 148/668, 403, 421; 420/423

(56) References Cited

U.S. PATENT DOCUMENTS

| | | | |
|---|---|---|---|
| 4,144,058 | A | 3/1979 | Chen et al. |
| 4,642,139 | A | 2/1987 | Taub et al. |
| RE32,925 | E | 5/1989 | Chen et al. |
| 5,288,344 | A | 2/1994 | Peker et al. |
| 5,711,363 | A | 1/1998 | Scruggs et al. |
| 5,735,975 | A | 4/1998 | Lin et al. |
| 5,740,854 | A | 4/1998 | Inoue et al. |
| 6,231,697 | B1 | 5/2001 | Inoue et al. |
| 6,258,185 | B1 | 7/2001 | Branagan et al. |
| 6,267,171 | B1 | 7/2001 | Onuki et al. |
| 6,427,753 | B1 | 8/2002 | Inoue et al. |

FOREIGN PATENT DOCUMENTS

| | | |
|---|---|---|
| EP | 0905268 | 3/1999 |
| EP | 0905269 | 3/1999 |
| JP | 11-189855 | 7/1999 |

(List continued on next page.)

OTHER PUBLICATIONS

Kuhn, U., et al., "ZrNbCuNiAl bulk metallic glass matrix composites containing dendritic bcc phase precipitates", Applied Physics Letters, vol. 80, No. 14, Apr. 8, 2002.

(List continued on next page.)

*Primary Examiner*—George Wyszomierski
*Assistant Examiner*—Janelle Combs Morillo
(74) *Attorney, Agent, or Firm*—Dickstein Shapiro Morin & Oshinsky LLP

(57) ABSTRACT

An alloy is described that is capable of forming a metallic glass at moderate cooling rates and exhibits large plastic flow at ambient temperature. Preferably, the alloy has a composition of $(Zr, Hf)_a\ Ta_bTi_cCu_dNi_eAl_f$, where the composition ranges (in atomic percent) are $45 \leqq a \leqq 70$, $3 \leqq b \leqq 7.5$, $0 \leqq c \leqq 4$, $3 \leqq b+c \leqq 10$, $10 \leqq d \leqq 30$, $0 \leqq e \leqq 20$, $10 \leqq d+e \leqq 35$, and $5 \leqq f \leqq 15$. The alloy may be cast into a bulk solid with disordered atomic-scale structure, i.e., a metallic glass, by a variety of techniques including copper mold die casting and planar flow casting. The as-cast amorphous solid has good ductility while retaining all of the characteristic features of known metallic glasses, including a distinct glass transition, a supercooled liquid region, and an absence of long-range atomic order. The alloy may be used to form a composite structure including quasi-crystals embedded in an amorphous matrix. Such a composite quasi-crystalline structure has much higher mechanical strength than a crystalline structure.

13 Claims, 5 Drawing Sheets

FOREIGN PATENT DOCUMENTS

| | | | | |
|---|---|---|---|---|
| JP | 2000-129378 | | 5/2000 | |
| JP | 2000-178700 A | * | 6/2000 | ..... C22C/45/10 |
| JP | 2000-265252 | | 9/2000 | |
| WO | WO 00/26425 | | 5/2000 | |
| WO | WO 00/68469 | | 11/2000 | |

OTHER PUBLICATIONS

Hays, C.C., et al., "Microstructure Controlled Shear Band Pattern Formation and Enhanced Plasticity of Bulk Metallic Glasses Containing in situ Formed Ductile Phase Dendrite Dispersons", Physical Review Letters, vol. 84, No. 13, Mar. 28, 2000.

Fan, C. and Inoue, A.; "Ductility of bulk nanocrystalline composites and metallic glasses at room temperature", *Applied Physics Letters,* vol. 77, No. 1, pp. 46–48, Jul. 3, 2000.

Fan, C.; Li, C.; Inoue, A.; Haas, V.; "Deformation behavior of Zr–based bulk nanocrystalline amorphous alloys", *Physical Review B* (*Condensed Matter*), vol. 61, No. 6, p. R3761–3, Feb. 1, 2000.

Saida, J.; Inoue, A.; "Icosahedral quasicrystalline phase formation in Zr–Al–Ni–Cu glassy alloys by addition of Nb, Ta and V elements", *Journal of Physics: Condensed Matter,* vol. 13, No. 4, p. L73–8, Jan. 29, 2001.

* cited by examiner

ALLOY WITH METALLIC GLASS AND QUASI-CRYSTALLINE PROPERTIES

This application claims priority from provisional application No. 60/234,976, filed Sep. 25, 2000, the entire disclosure of which is incorporated herein by reference.

GOVERNMENT INTEREST

This invention was made with government support under Grant No. DE-FG02-98ER45699 awarded by the Department of Energy and Grant No. DAAL-019620047 awarded by the U.S. Army Research Laboratory. The government has certain rights in the invention.

BACKGROUND

Metallic glasses, unlike conventional crystalline alloys, have an amorphous or disordered atomic-scale structure that gives them unique properties. For instance, metallic glasses have a glass transition temperature ($T_g$) above which they soften and flow. This characteristic allows for considerable processing flexibility. Known metallic glasses have only been produced in thin ribbons, sheets, wires, or powders due to the need for rapid cooling from the liquid state to avoid crystallization. A recent development of bulk glass-forming alloys, however, has obviated this requirement, allowing for the production of metallic glass ingots greater than one centimeter in thickness. This development has permitted the use of metallic glasses in engineering applications where their unique mechanical properties, including high strength and large elastic elongation, are advantageous.

A common limitation of metallic glasses, however, is their tendency to localize deformation in narrow regions called "shear bands". This localized deformation increases the likelihood that metallic glasses will fail in an apparently brittle manner in any loading condition (such as tension) where the shear bands are unconstrained. As a result, monolithic metallic glasses typically display limited plastic flow (0.5–1.5% under uniaxial compression) at ambient or room temperature. Several efforts have been made to increase the ductility of metallic glasses by adding second phases (either as fibers or particles, or as precipitates from the matrix) to inhibit the propagation of shear bands. While these additions can provide enhanced ductility, such composite materials are more expensive to produce and have less processing flexibility than monolithic metallic glasses.

Quasi-crystalline materials have many potentially useful properties, including high hardness, good corrosion resistance, low coefficient of friction, and low adhesion. However, known aluminum-based quasi-crystals produced by solidification are too brittle to be used as bulk materials at ambient temperature. Recently, precipitation of quasi-crystalline particles was found upon annealing bulk metallic glasses Zr—Cu—Ni—Al—O and Zr—Ti—Cu—Ni—Al. The quasi-crystalline phases in these alloys are metastable and can only be formed by annealing the amorphous precursor in a narrow temperature range between 670 K and 730 K.

SUMMARY

In accordance with a preferred embodiment of the invention, an alloy is provided that is capable of forming a metallic glass at moderate cooling rates (less than 1000 K/s) and that also exhibits large plastic flow, namely plastic strain to failure in compression of up to 6–7% at ambient temperature. Preferably, the novel alloy has a composition of $(Zr, Hf)_a Ta_b Ti_c Cu_d Ni_e Al_f$, where the composition ranges (in atomic percent) are $45 \leqq a \leqq 70$, $3 \leqq b \leqq 7.5$, $0 \leqq c \leqq 4$, $3 \leqq b+c \leqq 10$, $10 \leqq d \leqq 30$, $0 \leqq e \leqq 20$, $10 \leqq d+e \leqq 35$, and $5 \leqq f \leqq 15$.

In accordance with a preferred embodiment of the invention, the novel alloy may be cast into a bulk solid with disordered atomic-scale structure, i.e., a metallic glass, by a variety of techniques including copper mold die casting and planar flow casting. The as-cast amorphous solid has good ductility (greater than two percent plastic strain to failure in uniaxial compression) while retaining all of the characteristic features of known metallic glasses, including a distinct glass transition, a supercooled liquid region, and an absence of crystalline atomic order on length scales greater than two nm.

Moreover, the unique alloy may be used to form a composite structure including quasi-crystals embedded in an amorphous matrix. Such a composite quasi-crystalline structure has much higher mechanical strength than a crystalline structure.

DETAILED DESCRIPTION OF PREFERRED EMBODIMENTS

Figure 1:
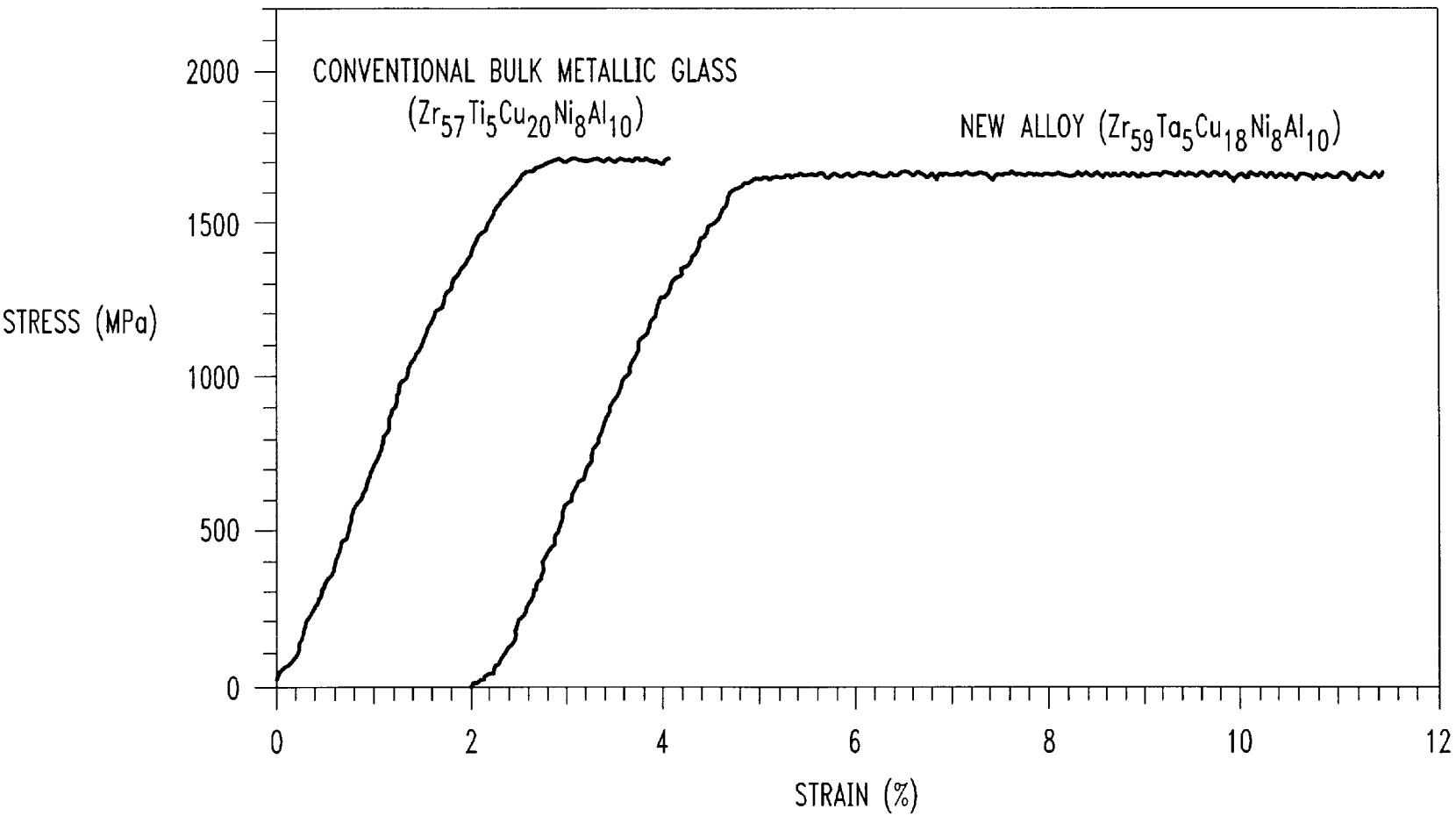
FIG. 1 is a plot of stress versus strain for a known metallic glass as compared with a metallic glass formed in accordance with an embodiment of the invention.

Preferred embodiments and applications of the invention will now be described. Other embodiments, applications, and other utilities may be realized and changes may be made to the disclosed embodiments without departing from the spirit or scope of the invention. Although the embodiments disclosed herein have been particularly described as applied to an alloy having metallic glass or quasi-crystalline properties, it should be readily apparent that the invention may be embodied to implement any composite material or method of making or using the same.

In accordance with a preferred embodiment of the invention, a material is provided which has improved ductility while retaining the other characteristic features of known bulk metallic glasses. The material preferably takes the form of an alloy with a composition of $(Zr, Hf)_a Ta_b Ti_c Cu_d Ni_e Al_f$, where the composition ranges (in atomic percent) are $45 \leqq a \leqq 70$, $3 \leqq b \leqq 7.5$, $0 \leqq c \leqq 4$, $3 \leqq b+c \leqq 10$, $10 \leqq d \leqq 30$, $0 \leqq e \leqq 20$, $10 \leqq d+e \leqq 35$ and $5 \leqq f \leqq 15$. This alloy can be made into metallic glass structures by any one or more known techniques that create an amorphous structure without a long-range atomic order, including casting the alloy into copper molds, melt-spinning, planar flow casting, etc. Injection die casting, for example, may be used to produce amorphous plates, rods, or net shape parts since the melt makes intimate contact with the mold, resulting in a relatively high cooling rate. Similarly, a simple technique that may be used for producing small amorphous parts is suction casting. Small amorphous ingots can also be produced by arc melting an ingot of the appropriate composition on a water-cooled copper hearth.

For any glass-forming alloy, the critical cooling rate is the minimum rate at which the alloy can be cooled without formation of crystalline (or quasi-crystalline) precipitates. For novel alloys having the composition described above, the critical cooling rates for avoiding crystallization and for forming a metallic glass are in the range 1–1000 degrees Kelvin per second (K/s), depending on the specific composition and purity of the alloy. Casting a one millimeter thick object in a copper mold, for example, produces cooling rates of around 1000 K/s, which is sufficient to produce the amorphous structure. Arc melting on a water-cooled copper hearth results in cooling rates on the order of 10–100 K/s, which is also sufficient for producing amorphous ingots of certain compositions.

In all metallic glass-forming alloys, the critical cooling rate is increased (and therefore the glass-forming ability is decreased) by the presence of impurities in the alloy. In particular, the presence of oxygen in an alloy can cause the formation of oxide particles which act as heterogeneous nucleation sites for the precipitation of crystalline phases. As a result, higher cooling rates are required to suppress crystallization and to produce an amorphous structure. In contrast, low levels of other metallic elements that dissolve in a molten alloy appear to not affect the critical cooling rate significantly.

Within the composition ranges described above, the critical cooling rate to avoid crystallization depends on the specific alloy composition. The relative glass-forming ability of a particular composition may be easily determined by casting the alloy into a wedge-shaped copper mold. In such a mold, both the thickness of the ingot and the cooling rate of the molten alloy increase with increasing distance from the apex of the wedge. Therefore, the distance from the apex at which the first crystalline phases are observed is a measure of glass-forming ability. The amorphous nature of the as-cast alloy can be verified by a variety of experimental techniques including x-ray diffraction and high resolution transmission electron microscopy. The presence of a glass transition observed with differential scanning calorimetry provides an indirect means of determining whether a structure is amorphous.

Amorphous alloys formed according to the novel composition range described above show no evidence for a long-range atomic order in either x-ray diffraction or high-resolution electron microscopy. They display a distinct glass transition around 670 K and crystallize at temperatures approximately 50 to 100 K above the glass transition temperature. The exact glass transition and crystallization temperatures depend on the actual alloy composition. The temperature interval between the glass transition and crystallization is called the supercooled liquid region and represents a range of temperatures over which the alloy has sufficiently low viscosity to be easily deformed and processed without crystallization.

Figure 2:
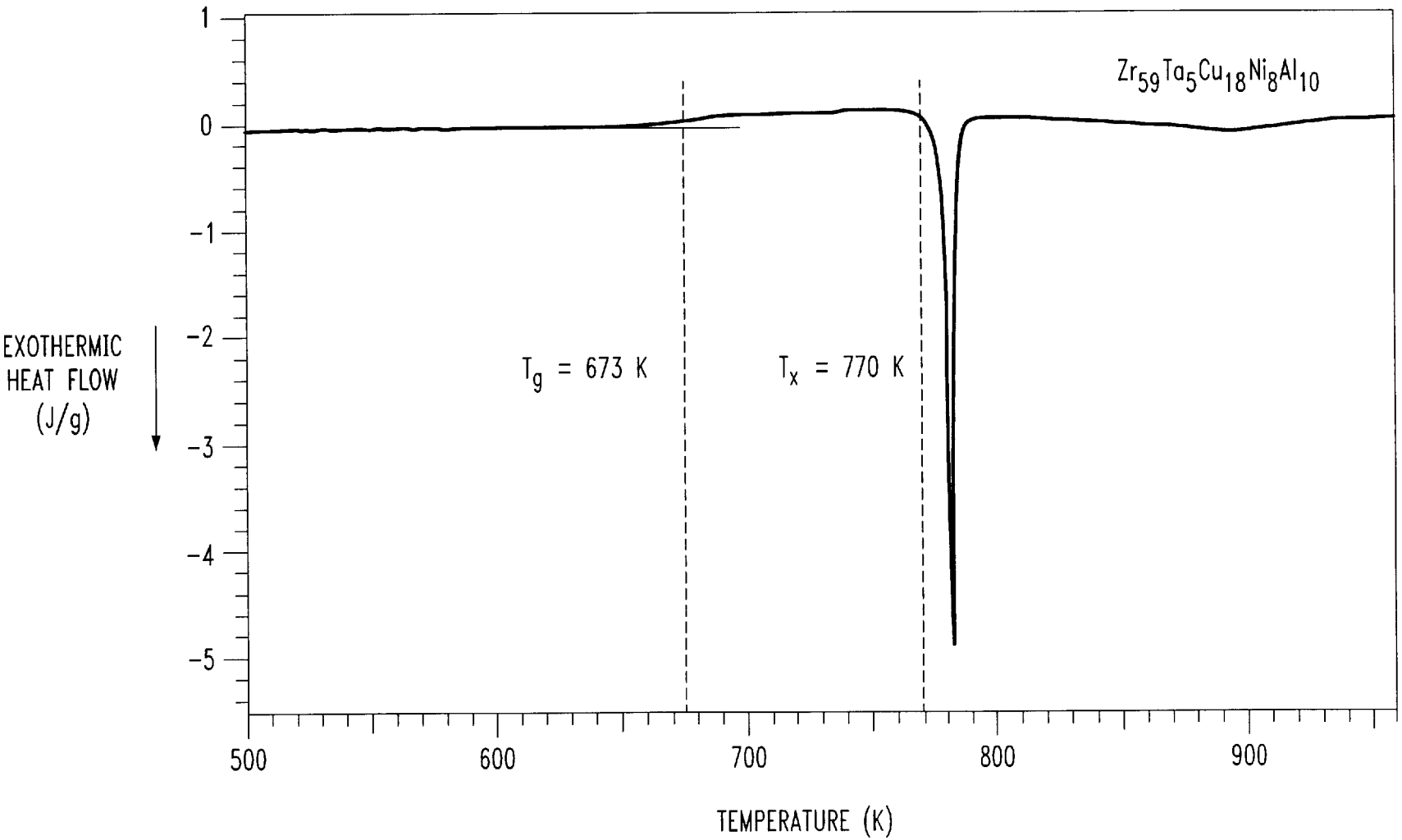
FIG. 2 is a plot of exothermic heat flow versus temperature of an alloy in accordance with an embodiment of the invention.

For example, and with special reference to FIG. 2, the exothermic heat flow in Joules per gram (J/g) is plotted against temperature (K) for a novel metallic glass having an exemplary composition of $Zr_{59}Ta_5Cu_{18}Ni_8Al_{10}$. As shown in FIG. 2, the transition glass temperature ($T_g$) is approximately 673 K. Further, the crystallization temperature is at about 770 K, slightly less than 100 K above the $T_g$ for the composition, and as manifested by the deep spike visible in FIG. 2.

The amorphous alloys formed according to the novel composition range described above generally exhibit yield stresses of 1.6 to 1.8 gigaPascals (GPa), yield point in compression (i.e., elastic strain) of about 2–2.5%, and plastic strain to failure in compression of about 3–7%. The plastic flow in compression of these novel alloys is significantly greater than that of known metallic glasses in which the plastic strain to failure in compression is in the range of 0.5 to 1.5%. The ductility of these new amorphous alloys appears to be strongly influenced by the titanium (Ti) and/or tantalum (Ta) content, although it is difficult to determine how these elements affect the structure of the amorphous alloy.

As shown in FIG. 1, the true stress (MPa) is plotted against true strain (%) for a known metallic glass having a composition of $Zr_{57}Ti_5Cu_{20}Ni_8Al_{10}$ and a novel alloy having an exemplary composition of $Zr_{59}Ta_5Cu_{18}Ni_8Al_{10}$. The preferred composition range for the optimal ductility is $Zr_aTa_bTi_cCu_dNi_eAl_f$, where the atomic percentages a through f are $45 \leqq a \leqq 70$, $4 \leqq b \leqq 6$, $4 \leqq b+c \leqq 7$, $10 \leqq d \leqq 25$, $5 \leqq e \leqq 15$, $15 \leqq d+e \leqq 30$, and $5 \leqq f \leqq 15$.

An alloy having a composition in accordance with a preferred embodiment, as described above, has numerous applications that are readily apparent to those of ordinary skill in the art. One application of this alloy, for example, is in structural applications where its unique combination of properties (e.g., high strength, large elastic elongation, significant ductility, high strength to density ratio) are advantageous. Such applications might include lightweight airframe structures, low temperature jet engine components, springs, sports equipment, and munitions (particularly kinetic-energy penetrators for anti-armor applications). The processing flexibility afforded by the glassy nature of the material may provide further applications where low volumes of high-performance materials can be cast to net shape in a single step. The relatively low stiffness and presumably good corrosion resistance of this alloy also may make it useful in orthopedic biomedical applications.

In accordance with a preferred embodiment of the invention, the alloys can be made to exhibit the formation of quasi-crystals upon cooling at a rate somewhat slower than the critical cooling rate for glass formation. In this case, the alloy can solidify into a composite structure consisting of quasi-crystalline precipitates embedded in an amorphous matrix. In this way, high strength bulk quasi-crystalline materials can be produced and thus the range of practical applications is extended. For example, quasi-crystalline materials typically have very low coefficients of friction and high hardness, making them useful for bearing applications.

In accordance with a preferred embodiment, the volume fraction and size of the quasi-crystalline precipitates are influenced by the cooling rate and the amount of Ti and Ta in the alloy. For any given alloy composition, both the volume fraction and size of the quasi-crystalline precipitates increase with decreasing cooling rates. It is believed that titanium significantly increases the nucleation rate of the quasi-crystalline phases, while tantalum increases the temperature range over which the precipitates form. The preferred composition range for forming composite structures of quasi-crystalline precipitates in an amorphous matrix or a fully quasi-crystalline structure is $Zr_aTa_bTi_cCu_dNi_eAl_f$, where the attomic percentages a through f are $45 \leqq a \leqq 70$, $2 \leqq b \leqq 7$, $2 \leqq c \leqq 7$, $4 \leqq b+c \leqq 25$, $10 \leqq d \leqq 25$.

An amorphous alloy can also form quasi-crystalline precipitates upon annealing in the supercooled liquid region if the composition is in the preferred range for quasi-crystal formation described above. Preferably, the volume fraction and size of the quasi-crystalline precipitates can be controlled by appropriate selection of annealing temperature and duration. This process results in nanometer-scale quasi-crystalline precipitates. In contact, quasi-crystalline precipitates formed during casting may range from nanometer-scale to micrometer-scale, depending on the cooling rate and the Ti and Ta content of the alloy.

EXAMPLES

To prepare amorphous samples, ingots of the desired composition were melted in an arc melter under an Argon atmosphere and then suction-cast them into copper molds. The as-cast amorphous rods are cylinders 100 millimeters long by three millimeters in diameter.

FIG. 1 shows quasi-static uniaxial compression stress-strain curves for a known bulk metallic glass ($Zr_{57}Ti_5Cu_{20}Ni_8Al_{10}$) and a novel metallic glass (containing an alloy of $Zr_{59}Ta_5Cu_{18}Ni_8Al_{10}$). The curve for the novel metallic glass has been offset two percent along the strain axis for clarity of illustration. The compression specimens, cut from the as-cast amorphous rods, were cylinders six millimeters long and three millimeters in diameter. The known bulk metallic glass displays a plastic strain to failure (i.e., total strain after yielding) of 1.3%. In contrast, the metallic glass in accordance with a preferred embodiment of the invention experiences plastic strain of 6.8% before failure.

FIG. 2 shows a differential scanning calorimetry scan of the novel amorphous alloy at a heating rate of 20 K/min. The alloy shows a distinct glass transition (a key characteristic of a metallic glass) at 673 K, and an onset of crystallization at around 770 K. The supercooled liquid region thus has a width of nearly 100 K.

Figure 3:
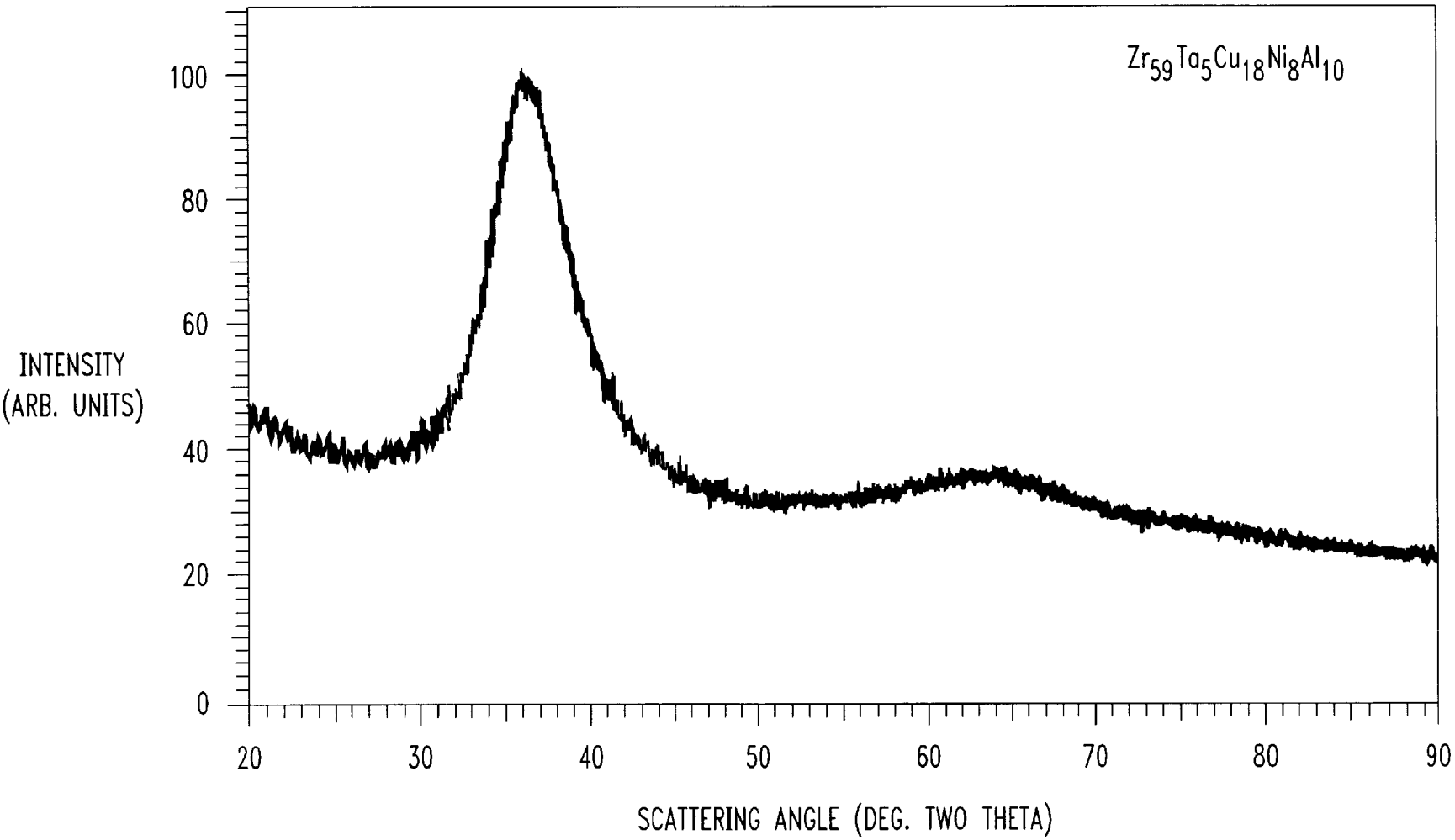
FIG. 3 is a plot of intensity versus x-ray diffraction pattern for an alloy in accordance with an embodiment of the invention.

FIG. 3 is an x-ray diffraction pattern (with an x-ray wavelength of 1.542 Angstroms) of the novel as-cast $Zr_{59}Ta_5Cu_{18}Ni_8Al_{10}$ amorphous alloy. The diffraction pattern is similar to that of conventional amorphous alloys with a broad amorphous scattering "halo" but no sharp diffraction peaks indicative of crystalline or quasi-crystalline phases.

Figure 4:
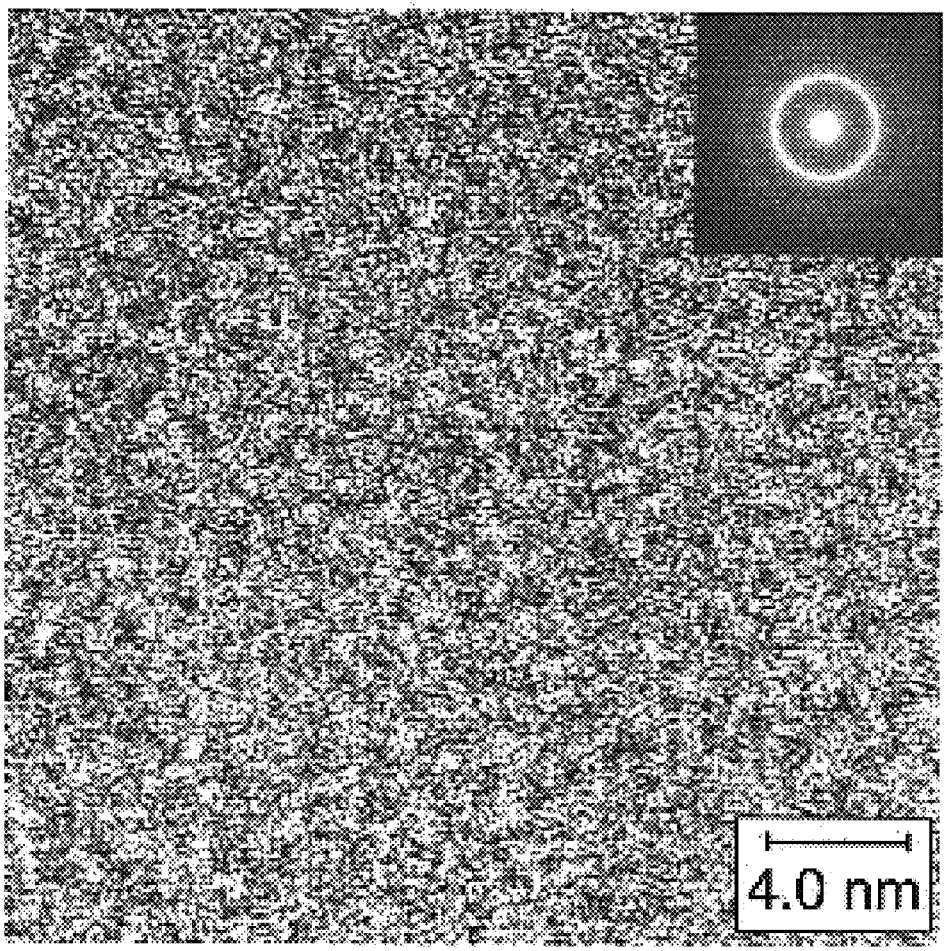
FIG. 4 illustrates a high resolution transmission electron micrograph from an alloy formed in accordance with an embodiment of the invention.

FIG. 4 is a high resolution transmission electron micrograph from a sample of the novel as-cast $Zr_{59}Ta_5Cu_{18}Ni_8Al_{10}$ amorphous alloy. This, together with the x-ray diffraction results (FIG. 3) and the differential scanning calorimetery results (FIG. 2), provides conclusive evidence that the alloy forms a metallic glass and not a crystalline structure.

Figure 5:
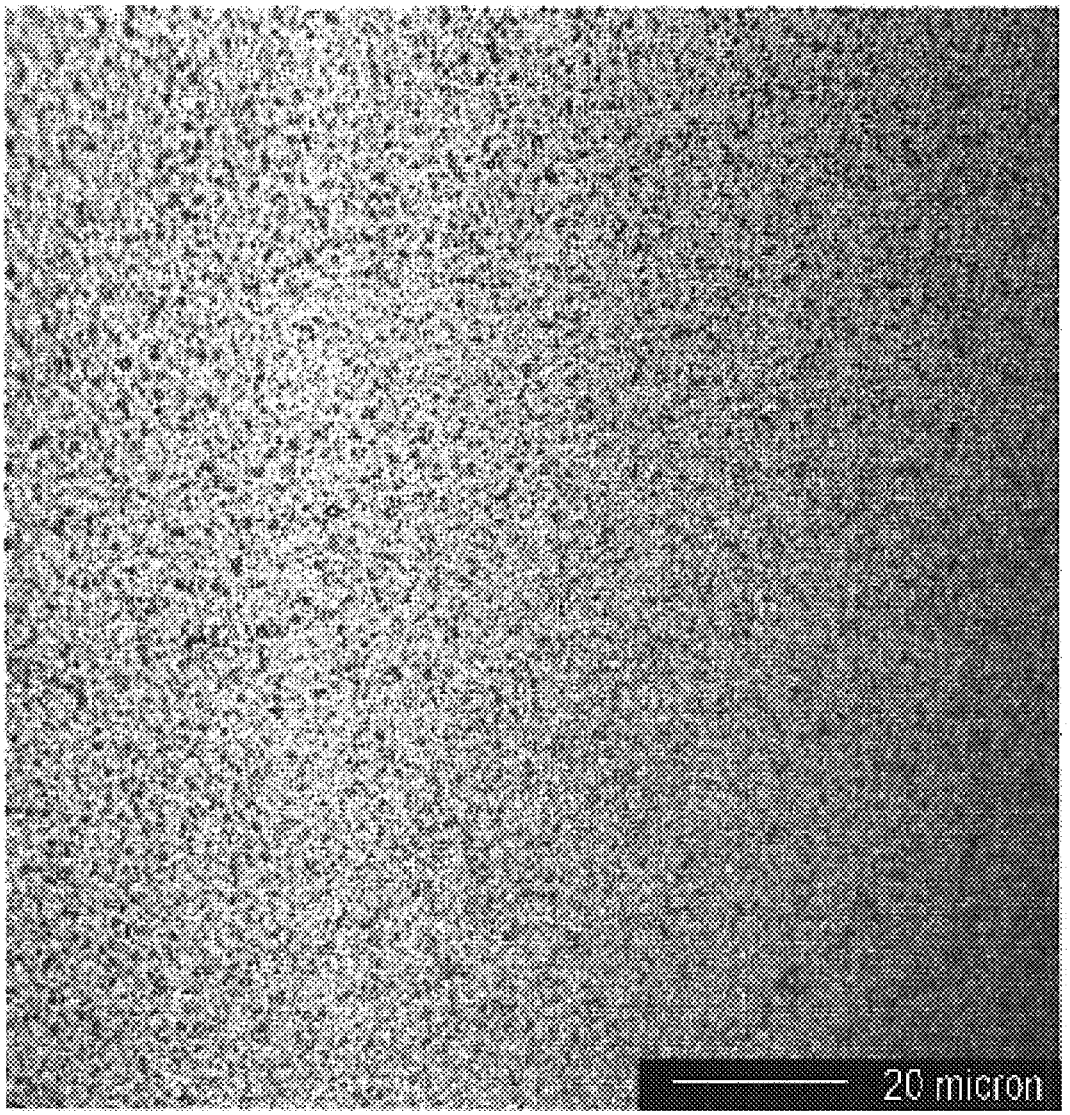
FIG. 5 illustrates a microstructure of an alloy formed in accordance with an embodiment of the invention.

FIG. 5 shows the microstructure of a novel $Zr_{56}Ti_3Ta_2Cu_{19}Ni_9Al_{11}$ ingot prepared by cooling an ingot on the copper hearth of the arc melter. Due to the lower cooling rate (compared to the copper-mold casting), the structure consists of submicrometer-scale icosahedral quasi-crystalline precipitates embedded in an amorphous matrix.

While the invention has been described in detail in connection with exemplary embodiments known at the time, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Accordingly, the invention is not to be seen as limited by the foregoing description, but is only limited by the scope of the appended claims.

What is claimed as new and desired to be protected by Letters Patent of the United States is:

1. A method of forming a metallic glass exhibiting a plastic strain to failure in compression of more than about 1.5 percent at ambient temperature, the method comprising:

providing an alloy having a composition of $Zr_aTa_bTi_cCu_dNi_eAl_f$, wherein the composition ranges in atomic percent are $45 \leqq a \leqq 70$, $2 \leqq b \leqq 7$, $2 \leqq c \leqq 7$, $4 \leqq b+c \leqq 25$, $10 \leqq d \leqq 25$, $5 \leqq e \leqq 15$, and $5 \leqq f \leqq 15$;

casting the alloy into an amorphous solid;

annealing the solid; and cooling the solid at a rate of between about 1 K/s and about 1000 K/s.

2. The method of claim 1, wherein said casting comprises copper mold casting.

3. The method of claim 1, wherein said casting comprises planar flow casting.

4. The method of claim 1, wherein said casting comprises injection die casting.

5. The method of claim 1, wherein said casting comprises suction casting.

6. The method of claim 1, wherein said casting comprises arc melting.

7. A method of forming a metallic glass exhibiting a plastic strain to failure in compression of more than about 1.5 percent at ambient temperature, the method comprising:

providing an alloy having a composition of $Zr_aTa_bTi_cCu_dNi_eAl_f$, wherein the composition ranges in atomic percent are $45 \leqq a \leqq 70$, $2 \leqq b \leqq 7$, $2 \leqq c \leqq 7$, $4 \leqq b+c \leqq 25$, $10 \leqq d \leqq 25$, $5 \leqq e \leqq 15$, and $5 \leqq f \leqq 15$; and casting the alloy into an amorphous solid.

8. The method of claim 7, further comprising the steps of:

annealing the solid; and cooling the solid at a rate of between about 1 K/s and about 1000 K/s.

9. The method of claim 7, wherein said casting comprises copper mold casting.

10. The method of claim 7, wherein said casting comprises planar flow casting.

11. The method of claim 7, wherein said casting comprises injection die casting.

12. The method of claim 7, wherein said casting comprises suction casting.

13. The method of claim 7, wherein said casting comprises arc melting.

* * * * *